US008065854B1

(12) United States Patent
Doberstein et al.

(10) Patent No.: US 8,065,854 B1
(45) Date of Patent: Nov. 29, 2011

(54) ROOFING COMPOSITION

(75) Inventors: Craig Paul Doberstein, Seattle, WA (US); Courtney Van Roy Harris, Seattle, WA (US)

(73) Assignee: Engineering Innovations, LLC, Seattle, WA (US)

( * ) Notice: Subject to any disclaimer, the term of this patent is extended or adjusted under 35 U.S.C. 154(b) by 0 days.

(21) Appl. No.: 12/787,969

(22) Filed: May 26, 2010

Related U.S. Application Data

(62) Division of application No. 12/114,919, filed on May 5, 2008, now Pat. No. 7,743,573.

(60) Provisional application No. 60/973,093, filed on Sep. 17, 2007.

(51) Int. Cl.
*E04B 1/00* (2006.01)

(52) U.S. Cl. ... 52/746.11; 52/518; 52/782.1; 52/169.14; 52/540

(58) Field of Classification Search ..... 52/518, 52/782.1, 169.14, 540, 746.11, 749.12; 428/166, 428/188, 304.4, 116
See application file for complete search history.

(56) References Cited

U.S. PATENT DOCUMENTS

| | | | | | |
|---|---|---|---|---|---|
| 1,412,295 | A | | 4/1922 | Speer | |
| 1,475,551 | A | | 11/1923 | Overbury | |
| 2,144,678 | A | | 1/1939 | Goldschmidt, Sr. | |
| 2,205,679 | A | | 6/1940 | Ames, Jr. | |
| 2,571,057 | A | | 10/1951 | Patterson | |
| 3,186,896 | A | * | 6/1965 | Clem | 428/182 |
| 3,407,557 | A | | 10/1968 | Shaw | |
| 3,445,322 | A | * | 5/1969 | Saiia et al. | 428/178 |
| 3,561,177 | A | * | 2/1971 | Agro et al. | 52/169.14 |
| 3,638,388 | A | | 2/1972 | Crookston | |
| 3,773,603 | A | * | 11/1973 | Scholander | 428/59 |
| 3,927,501 | A | | 12/1975 | Allen | |
| 4,121,958 | A | * | 10/1978 | Koonts | 156/79 |
| 4,301,633 | A | * | 11/1981 | Neumann | 52/309.4 |
| 4,450,663 | A | * | 5/1984 | Watkins | 52/309.4 |
| D282,287 | S | | 1/1986 | McKeagan | |
| 4,651,494 | A | * | 3/1987 | Van Wagoner | 52/592.1 |
| 4,856,251 | A | * | 8/1989 | Buck | 52/553 |
| 4,869,942 | A | | 9/1989 | Jennus | |
| 4,943,185 | A | * | 7/1990 | McGuckin et al. | 405/45 |
| 5,067,298 | A | * | 11/1991 | Petersen | 52/742.14 |
| 5,069,950 | A | * | 12/1991 | Crookston, Sr. | 428/156 |
| 5,112,678 | A | * | 5/1992 | Gay et al. | 442/173 |
| 5,181,361 | A | | 1/1993 | Hannah | |
| 5,319,900 | A | * | 6/1994 | Lehnert et al. | 52/408 |
| 5,557,896 | A | * | 9/1996 | Imeokparia et al. | 52/408 |
| 5,644,880 | A | * | 7/1997 | Lehnert et al. | 52/408 |
| 5,678,369 | A | * | 10/1997 | Ishikawa et al. | 52/309.9 |
| 5,724,766 | A | * | 3/1998 | Behrens | 47/56 |
| 5,784,845 | A | * | 7/1998 | Imeokparia et al. | 52/408 |
| 5,791,109 | A | * | 8/1998 | Lehnert et al. | 52/309.17 |
| 5,860,259 | A | * | 1/1999 | Laska | 52/302.3 |
| 6,017,597 | A | * | 1/2000 | Minakami et al. | 428/34.4 |
| 6,164,034 | A | | 12/2000 | Roetheli | |
| 6,606,823 | B1 | * | 8/2003 | McDonough et al. | 47/65.9 |
| 6,708,456 | B2 | * | 3/2004 | Kiik et al. | 52/98 |
| 6,767,160 | B2 | | 7/2004 | Sansalone | |

(Continued)

*Primary Examiner* — Brian Glessner
*Assistant Examiner* — Joshua Ihezie
(74) *Attorney, Agent, or Firm* — Christensen O'Connor Johnson Kindness PLLC

(57) ABSTRACT

A roofing composition is formed as a shingle or from one or more separate sheets. The roofing composition includes a storage layer with an inert non-growing storage medium to absorb and detain precipitation for gradual release. The roofing composition reduces hydraulic discharge rates to avoid overloading downstream drainage systems.

6 Claims, 5 Drawing Sheets

U.S. PATENT DOCUMENTS 6,797,162 B2 9/2004 Happel
6,804,922 B1 * 10/2004 Egan ..... 52/408
6,864,195 B2 3/2005 Peng
6,869,528 B2 3/2005 Pank
6,936,329 B2 * 8/2005 Kiik et al. ..... 428/141
2002/0007593 A1 * 1/2002 Mischo ..... 47/86
2003/0230040 A1 * 12/2003 Shirota ..... 52/302.1
2006/0016141 A1 1/2006 Appel
2006/0147677 A1 * 7/2006 Miyata et al. ..... 428/166
2007/0094927 A1 * 5/2007 Perry ..... 47/65.9

* cited by examiner

ROOFING COMPOSITION

CROSS-REFERENCES TO RELATED APPLICATIONS

This application is a division of U.S. patent application Ser. No. 12/114,919, filed May 5, 2008, which claims the benefit of U.S. Provisional Application No. 60/973,093, filed on Sep. 17, 2007, both of which applications are incorporated herein expressly by reference.

BACKGROUND

A wide variety of roofing materials has been developed over the years to provide lasting protection of a building. While most of the available alternatives have provided adequate protection of buildings, a common characteristic with most available materials is that they are impervious to precipitation, the intent being to prevent precipitation from penetrating the roofing surface and impacting the underlying structure. However, one consequence from a stormwater management perspective has been a steady increase in impervious surfaces associated with the footprint of most new developments. The introduction of impervious surfaces translates into increased volumes of stormwater runoff and increased rates at which this runoff leaves a given site. In predeveloped conditions (i.e., before a structure and roof), there are typically trees, grasses, shrubs, and other natural ground covers that allow for infiltration, evapotranspiration, and a generally slow rate of surface runoff from precipitation. New structures and the impervious rooftops change the hydrology of a site considerably by creating a fast and efficient path for precipitation to leave the structure and, ultimately, the property.

This widespread change of land cover and associated change in surface runoff hydrology has led to similarly widespread problems with stormwater management throughout the country and world. In watersheds drained by open channels, the increased rate and volume of stormwater runoff can cause flooding and erosion in downstream ditches, streams, and rivers. In man-made systems, the change in hydrology can cause overloaded conveyance systems, property damage, and other related consequences. As a result, many jurisdictions in the United States and worldwide have developed stormwater regulations that, among other things, set regulatory limitations on the rate at which stormwater runoff can leave a site. Typical approaches to achieving these regulations include providing stormwater detention or retention systems to capture and temporarily store stormwater runoff and release it at a slower rate or infiltrate it into surrounding soils.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

While development inevitably leads to a change in land cover, the embodiments of a roofing composition disclosed herein seek to minimize the impact of traditional impervious roofing systems on downstream hydrology. Rather than accepting the notion that rooftops are impervious surfaces and then trying to manage the increased rate of stormwater runoff by capturing the roof runoff and detaining or retaining it after it leaves the rooftop, the roofing composition will help slow the rate at which stormwater runoff is able to leave the roof surface by temporarily storing the precipitation on the rooftop within a porous storage layer incorporated into the roofing composition. To this end, embodiments of the roofing composition provide a roofing material and system that is still impervious to weather at its base, but includes a storage layer above the base layer comprised of natural or synthetic materials other than growing media (i.e., green roofs) that will allow for the temporary holding and gradual and controlled delayed release of the majority of precipitation that falls onto the roof surface. The storage layer may be designed to inhibit biological growth (e.g., plant or bacterial), or may allow for incidental biological growth, but unlike green roof systems, the storage layer is specifically designed as a manufactured precipitation storage media and not a plant growth media. To this end, the storage media is preferably made from an inert non-growing material. Additionally or alternatively, the storage media may comprise a biocide, herbicide, algaecide, or bactericide to prevent the growth of plant, animal and other living matter.

A further embodiment provides a roofing composition and unit that can be easily manufactured, stockpiled, distributed, and installed on typical roofs.

A further embodiment provides a roofing composition and unit that is standard in its purpose but variable and customizable in thickness, porosity, and hydraulic conductivity such that it can meet the unique precipitation, stormwater regulatory, and roof slope properties of a given site.

A further embodiment provides a roofing composition and unit that is applicable to both new and existing structures (e.g., incorporated as part of a standard re-shingling effort).

A further embodiment provides a lightweight roofing composition and unit of sufficient strength, stiffness, and impact resistance to withstand the variety of outdoor conditions encountered, including hail, freeze/thaw, snow load, high winds, and foot traffic.

A further embodiment provides a roofing composition and unit that maximizes the use of post consumer and/or post industrial materials.

A further embodiment provides a roofing composition and unit with equal or superior product longevity over typical roofing materials.

A further embodiment provides a roofing composition and unit that is variable and customizable in appearance, such that it may be tailored to appear similar to typical asphalt shingle roofing, slate roofing, or other roofing materials as desired.

A further embodiment provides a roofing composition and unit that is resistant to pests, bacteria, and fungus.

A further embodiment provides a roofing composition and unit with equal or greater solvent, detergent, and other chemical resistance than typical metal, PVC, or asphalt roofing products.

A further embodiment provides a roofing composition and unit with a Class C or higher fire rating.

A further embodiment provides a roofing composition and unit that conserves the use of industrial and energy resources, and produces less waste in the creation and installation of the material compared to other common roofing materials.

A further embodiment provides a roofing composition and unit that maximizes the content of recyclable materials.

These and other embodiments of the roofing composition disclosed herein provide interception and temporary storage (detention) of precipitation and stormwater runoff on the roof surface. This application discloses a means to reduce on-site or off-site stormwater detention and retention needs by providing for deliberate detention of precipitation and stormwater runoff on the rooftop before it is released to the site stormwater drainage system. The rooftop stormwater detention provides a reduced release of stormwater runoff compared to traditional roofing systems, allowing for reduced or elimination of the need for other stormwater flow control facilities to manage the runoff from the rooftop. Embodiments of the roofing composition could also be customized with simple changes to material dimensions and composition to meet varying regulatory requirements and precipitation patterns. Embodiments of the roofing composition provide an improved means to meet any regulatory requirements for stormwater detention, and provide improved environmental protection by partially simulating the hydrologic characteristics of an undisturbed (pervious) surface that typically existed historically prior to the disturbance and development of the building site. In addition to the stormwater detention and environmental benefit, other benefits include improved service life of the roofing material, improved insulation, and the potential for reduced gutter clogging and maintenance.

Embodiments of the roofing composition include a multi-layered system that will provide the same protection of the underlying roof surface (typically plywood) that traditional roofing materials provide, but will also allow for increased storage and detention of precipitation and stormwater runoff.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The present invention is related to roofing compositions. The roofing composition includes a plurality of layers. Embodiments of the roofing composition can be provided as individual units or shingles or the roofing composition can be constructed from larger sheets placed individually on the roof. Any one or more of the disclosed layers can be fabricated from such a large sheet of material. Embodiments of the roofing compositions are related to the field of roofing materials, and are designed to respond to demands in stormwater management. Embodiments of the roofing compositions provide a roofing system possessing characteristics desired in standard roofing materials including durability, impermeability, weather resistance, fire resistance, and aesthetic appeal. However, the embodiments of the roofing composition also include a water-holding storage layer which will reduce the rate of stormwater runoff from a roof surface. This provides important stormwater management functions that are lacking in most current roofing approaches. For example, conventional green roofs (i.e., where soil and plant material are used to cover a building) provide some stormwater management benefits. However, unlike the conventional green roofs, embodiments of the roofing compositions disclosed herein provide a system that is more suited to mass manufacturing and ease of installation, which are desirable characteristics for roofing installations. Embodiments of the roofing composition also do not rely on soil and living plant material. Roofing compositions disclosed herein can use manufactured materials that will provide precise and customizable stormwater detention capabilities desired for a given setting. Embodiments of the roofing composition can be fabricated as individual roofing shingles, much like the conventional shingle design, but the embodiments disclosed herein incorporate a stormwater storage layer that will provide additional benefits.

Figure 1:
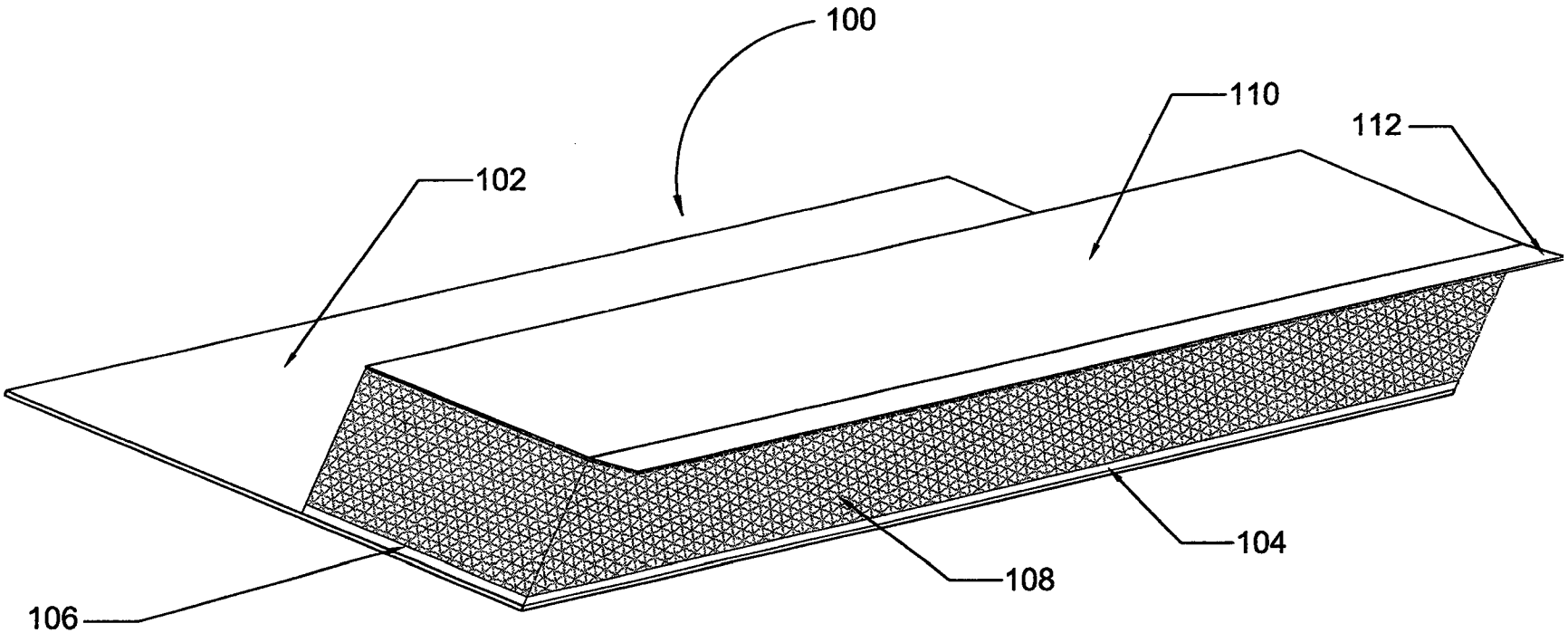
FIG. 1 is a diagrammatical illustration of a first embodiment of a roofing composition in accordance with the present invention.

Referring to FIG. 1, a representative roofing composition 100 in accordance with one embodiment is illustrated. Roofing compositions in accordance with embodiments of the invention include at least a storage layer and a base layer. "Layer" as used herein in plural or singular form may designate completely separate and distinct materials, or "layer" may designate a zone or area of a material that performs or behaves differently than another zone or area of the same material or may designate a zone or area having a different structure and/or composition than another zone or area of the same material. While the following description is with reference to particular embodiments of the roofing composition, the invention is not thereby limited to any one particular embodiment.

In FIG. 1, the lowermost layer 102 is a base layer 102. The base layer 102 includes a water-impermeable underlayment material made of, for example, asphalt impregnated felt, high density polyethylene, recycled rubber, metal, or other impermeable synthetic or naturally-occurring material. The base layer 102 extends, at least, the length, height, and depth of the remaining layers, but is further extended beyond the remaining layers for generally more than twice the depth of the remaining layers. The base layer 102 is placed on the roofing support structure, such as, but not limited to, plywood. The base layer 102 is a durable, impermeable layer that will serve as the base and waterproofing system to be attached to the roof surface. This layer can be constructed of metal, synthetic materials, or other durable and impervious materials.

One or more layers disclosed herein can be installed singly as a unit or shingle. In another embodiment one or more layers could be installed in large sheets or panels (as opposed to individual shingles) over large portions of the roof surface. Depending on the other layers described below, the base layer may be flat, or may include ridges on the upper facing side of the layer to serve as drainage channels. Most sections would likely be rigid, but there will be some need for moderately flexible materials to fit contoured roof segments. The base layer may be attached to the support structure through a variety of methods including mechanical fastening, chemical adhesives and bonding agents, heat-sealing, hook and eye, VELCRO, or other methods.

If a drainage layer 104 is used, the drainage layer 104 is placed over the base layer 102. The drainage layer 104 is provided with means to direct water transversely within the drainage layer 104. More specifically, when water enters the drainage layer 104, water is allowed to run transversely through the drainage layer 104 according to the slope of the roof on which the roofing composition 100 is located. To this end, the drainage layer 104 can include voids, channels, tunnels, pores, or any other water-channeling structure to allow for the flow of water through the height, depth, and length of the drainage layer 104 and for directing water downslope beneath the drainage layer 104. The drainage layer 104 serves as the drainage section that will convey detained runoff along the base of the unit. This layer can be constructed of metal, synthetic materials, or other durable materials. Depending on the other system layers, the drainage layer may include various geometric designs to serve as drainage pathways that convey water from the storage layer to discharge at the terminus of the roofing system. The drainage layer may also be configured such that precipitation is retained in the drainage layer and allowed to evaporate back into the atmosphere rather than drain from the roofing system. The drainage layer 104 could be adhered to the base layer 102 through a variety of methods including mechanical fastening, chemical adhesives and bonding agents, heat-sealing, hook and eye, VELCRO, or other methods. As mentioned for the base layer 102, another embodiment of the drainage layer 104 could include large sheets or panels (as opposed to shingles) installed over large portions of the roof surface.

If a separation layer is used, the separation layer 106 is placed over the drainage layer 104. The separation layer 106 supports the storage layer 108 to keep the storage layer 108 from encroaching on the drainage pathways in the drainage layer 104. The separation layer 106 could be constructed of geosynthetic materials or other durable materials. The separation layer 106 should be highly permeable to allow water stored in the storage layer 108 to flow freely to the drainage pathways in the drainage layer 104. As mentioned for the other layers, another embodiment of the separation layer 106 could include large sheets or panels (as opposed to shingles) installed over large portions of the roof surface.

The storage layer 108 is placed over the separation layer 106, if present. Alternatively, the storage layer 108 may be placed directly on the drainage layer 104, if present. If the separation layer 106 and the drainage layer 104 are not included, the storage layer 108 may be placed directly on the base layer 102. The storage layer 108 includes inert non-growing storage means or media for absorbing and temporarily detaining precipitation for gradual release. In one embodiment, the storage layer has the capacity to detain at least 0.3175 centimeters (0.125 inches) of precipitation when fully saturated and in one embodiment has a water permeability (hydraulic conductivity) of 0.00001 to 0.1 centimeters per second. Individual embodiments will be tailored to match the environmental conditions and design needs of different applications. In another embodiment, the storage layer has a hydraulic conductivity of 0.00001 to 0.0001 centimeters per second. In another embodiment, the storage layer has a hydraulic conductivity of 0.0001 to 0.001 centimeters per second. In another embodiment, the storage layer has a hydraulic conductivity of 0.001 to 0.01 centimeters per second. In another embodiment, the storage layer has a hydraulic conductivity of 0.01 to 0.1 centimeters per second. Methods for determining hydraulic conductivity vary depending on test material and permeability, but are generally based on Darcy's Law and should follow applicable standard test methods such as ASTM D5856 or ASTM D2434. The storage layer 108 includes an inert non-growing storage media that has temporary water storage characteristics. The preferred materials for the storage media would be determined through field and/or laboratory testing but may include a honeycombed style material, open-cell foam material, a semi-rigid sponge material, a woven fibrous material, layers of synthetic fabric layers of varying permeability, or other materials with desired water storing and hydraulic conductivity characteristics. The preferred materials would also vary depending on climate, stormwater detention objectives, aesthetics, and other site-specific needs. The layer may also provide varying degrees of storage through the depth of the material. In one embodiment, the storage layer may have two or more zones having a different hydraulic conductivity, wherein the zones are arranged such that water can be conveyed through the storage layer at variable design rates. For example, a higher hydraulic conductivity near the surface to promote absorption of precipitation, a slower hydraulic conductivity in the middle to promote storage, and a higher hydraulic conductivity near the base to promote drainage of runoff from the roof material. As mentioned for the other layers, another embodiment of the storage layer 108 could include large sheets or panels (as opposed to shingles) installed over large portions of the roof surface.

If a surface layer is used, the surface layer 110 is placed over the storage layer 108. The surface layer is capable of allowing for the passage of precipitation through its thickness for passage into the storage layer 108. In one particular embodiment as illustrated in FIG. 1, the surface layer 110 may include a tab 112 running the entire length of the surface layer 110 and extending in the depth dimension beyond the remaining layers for a small amount to overlap the seams created by placing a first roofing composition adjacent to a second roofing composition. The surface layer 110 could have several embodiments but likely would include a highly permeable but durable membrane. The surface layer 110 would generally be durable, UV resistant, and weather (wind, storm, and frost) resistant. The materials could also vary according to the desired aesthetic appearance—for example, to mimic the appearance of traditional asphalt shingles, slate shingles, wood shingles, etc. The surface layer 110 should resist penetration by leaves, needles, or other materials typically deposited on rooftops, but would also promote the rapid absorption and pass-through of precipitation through the surface layer 110 to the storage layer 108 below. The surface layer 110 should have sufficient strength and surface texture to allow safe walking on the roof surface. The surface layer 110 may be permanently fastened or bonded to the storage layer 108, or may be independent such that it can be installed after the other layers are installed. The surface layer 110 can be of variable color and texture (for appearance), and in one embodiment can be removed for cleaning or replacement without removing the entire system. As mentioned for the other layers, another embodiment of the surface layer 110 could include large sheets or panels (as opposed to shingles) installed over large portions of the roof surface.

In other embodiments, there may be a need for an additional drainage layer to improve flow routing through the system, as well as a wrapping or packaging layer to securely enclose the storage layer 108. Other perimeter layers may also be needed to secure the system, prevent damage, improve appearance, or otherwise maximize the performance measures.

Figure 2:
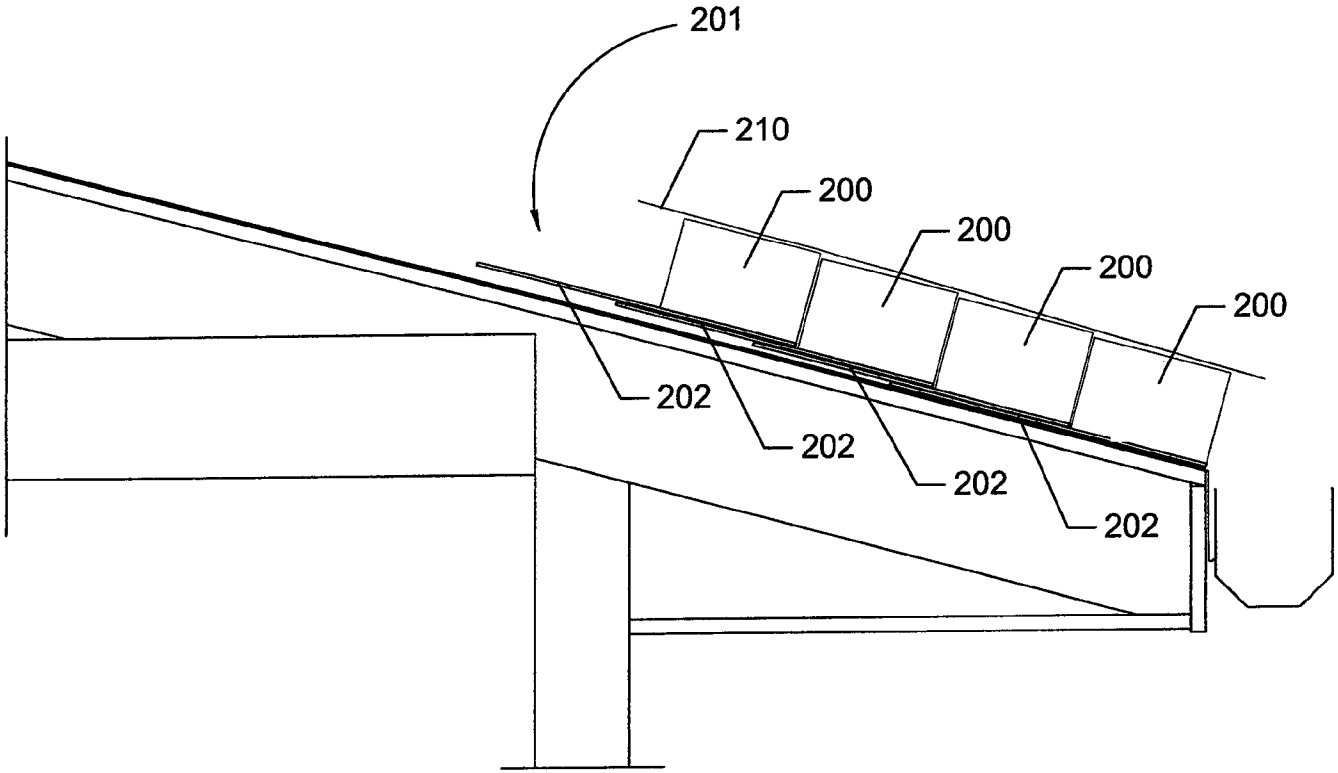
FIG. 2 is a diagrammatical illustration of a roof including the roofing composition made in accordance with the present invention.

FIG. 2 is a diagrammatical illustration showing a cross-sectional view of a roof structure 201 having a plurality of roofing compositions 200 in accordance with one embodiment. The roof includes multiple individual roofing composition units or shingles 200. In place of individual surface layers for each unit or shingle 200, this embodiment uses a large sheet surface layer 210 to cover multiple shingles 200. This construction method is not limited solely to the surface layer. Any layer disclosed herein can be applied in large sheets covering more than one shingle. Also visible in FIG. 2 are the base layers 202 overlapping the entire depth of adjacent shingles. The base layers extend from a lower edge of a roofing composition to the roofing composition adjacent and behind the roofing composition and even further beyond the second roofing composition.

Figure 3:
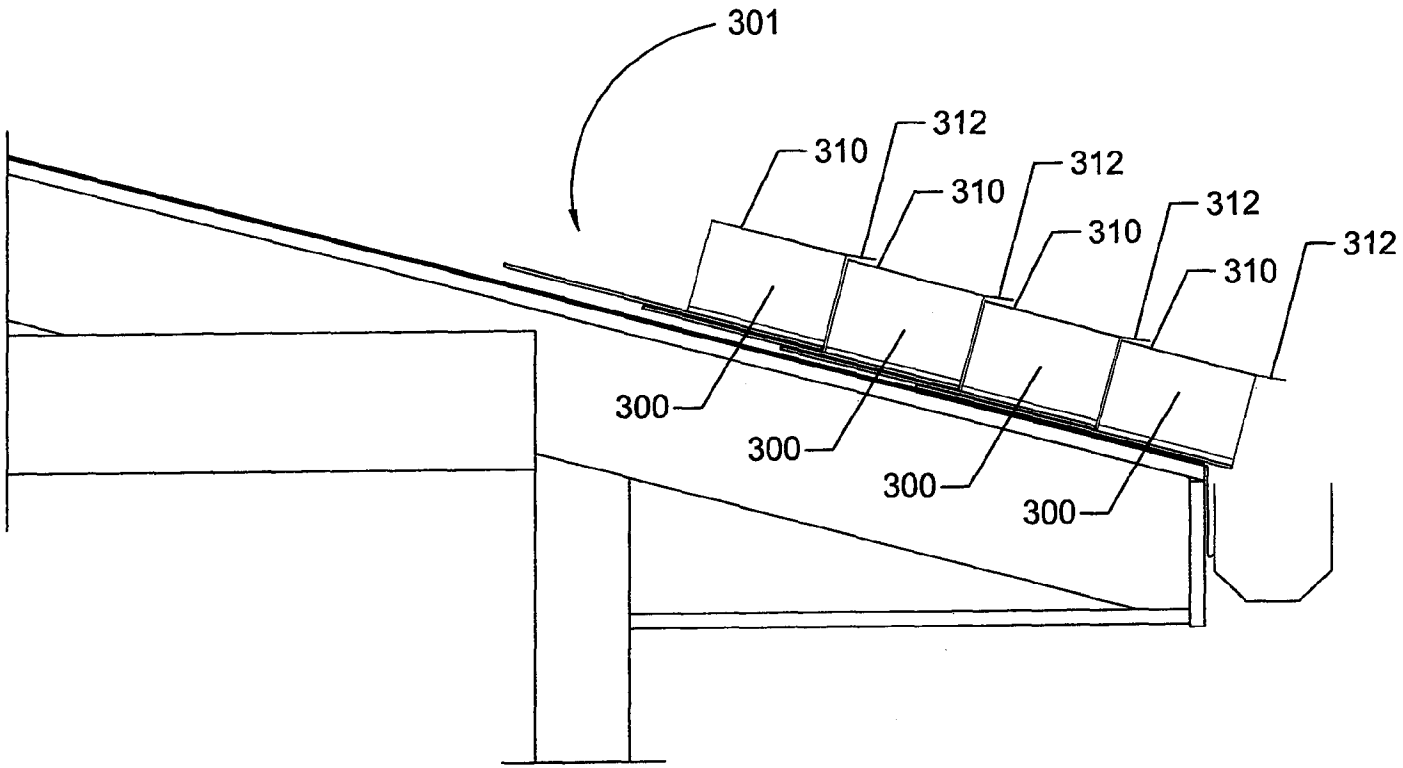
FIG. 3 is a diagrammatical illustration of a roof including the roofing composition made in accordance with the present invention.

FIG. 3 is a diagrammatical illustration showing a cross-sectional view of a roof structure 301 having a plurality of roofing composition units or shingles 300 utilizing the roofing composition shingles of FIG. 1, that include a surface layer with a tab 112. FIG. 3 illustrates roofing composition shingles 300 where each individual shingle or unit 300 has its own attached surface layer 310 with a tab 312.

By way of contrast to the construction method of FIG. 2, FIG. 3 illustrates a plurality of roofing compositions 300 that include a surface layer 310 and a tab 312 that extends over the seam created by placing more than one roofing composition next to each other.

Figure 4:
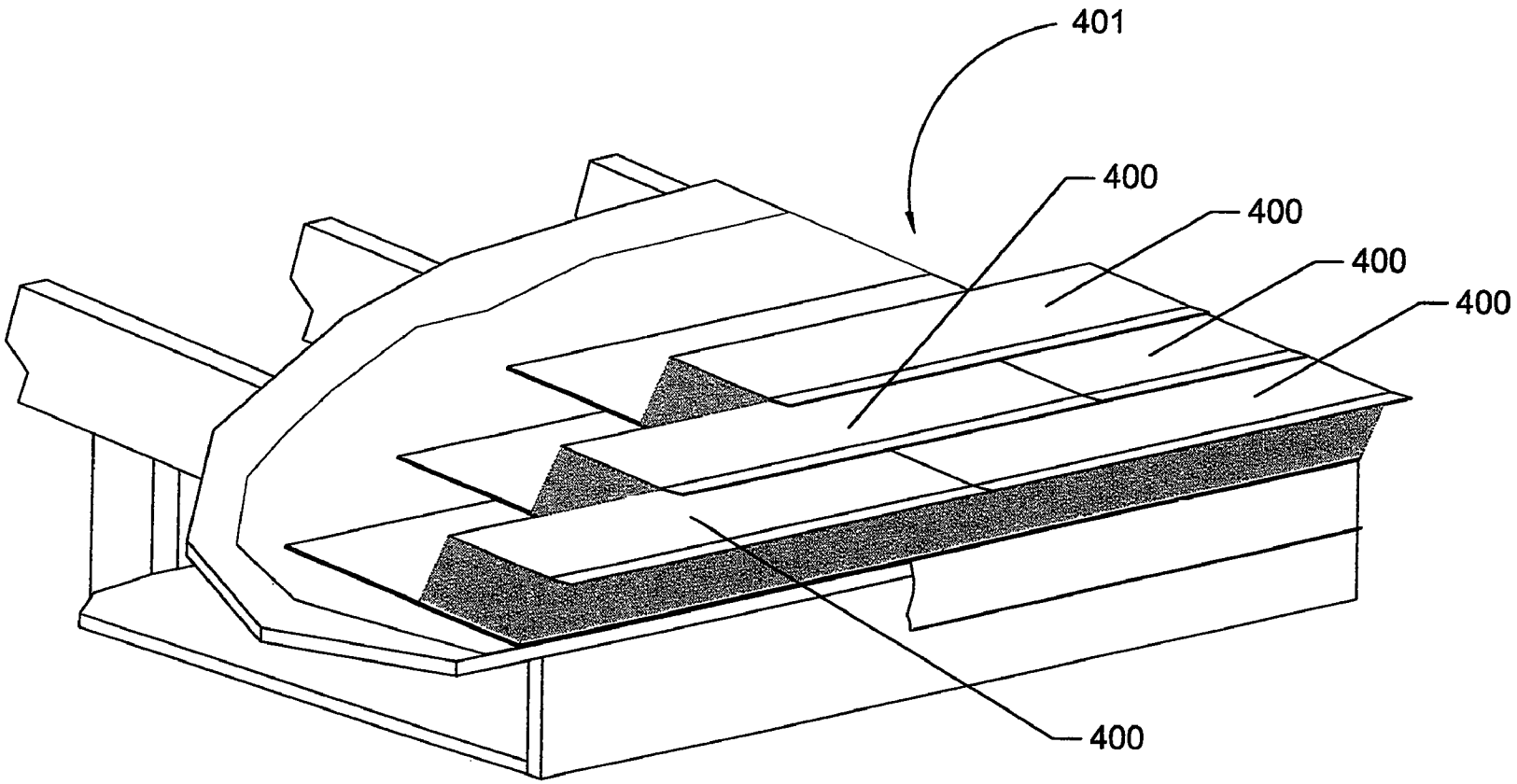
FIG. 4 is a diagrammatical illustration of a roof including the roofing composition made in accordance with the present invention.

FIG. 4 is an illustration of a roof structure 401 with a plurality of roofing compositions 400 with individual surface layers for each roofing composition 400, utilizing the roofing composition shingles of FIG. 3, for example.

Figure 5:
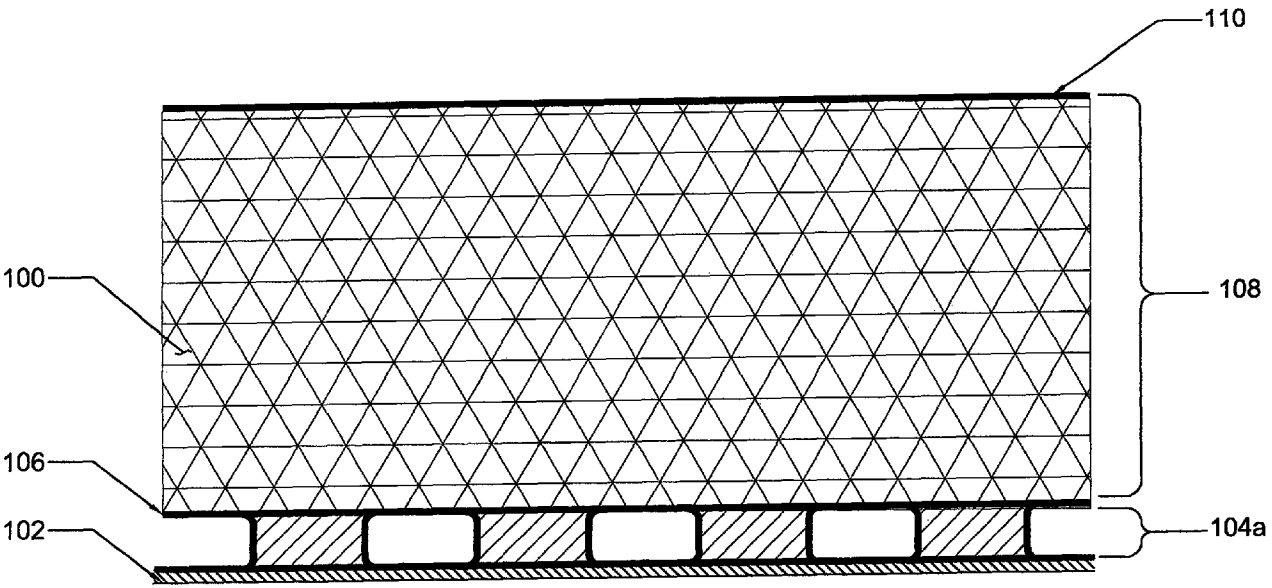
FIG. 5 is a diagrammatical illustration of a cross-sectional view of a roofing composition in accordance with the present invention.

FIG. 5 illustrates a representative cross section of drainage layer 104*a*, wherein the drainage layer 104*a* includes a repeating pattern of supports that create voids and/or channels in the drainage layer 104*a*. The channels are preferably arranged so that when placed on a roof, the channels direct the flow of water from a higher elevation to a lower elevation. However, there may be cross channels that also allow water to flow in a direction perpendicular to the downstream flow of water.

Figure 6:
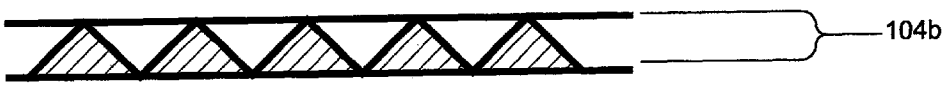
FIG. 6 is a diagrammatical illustration of a cross-sectional view of an alternative embodiment of a drainage layer in accordance with the present invention.

Referring to FIG. 6, an alternative embodiment of a drainage layer 104*b* is illustrated. The drainage layer cross-sectional view illustrates that the supports are fabricated in a saw-tooth configuration. Cross channels may also be provided to allow water to flow in a direction perpendicular to the downstream flow of water.

Figure 7:
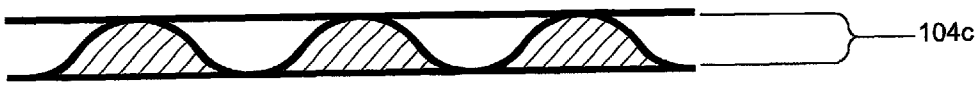
FIG. 7 is a diagrammatical illustration of a cross-sectional view of an alternative embodiment of a drainage layer in accordance with the present invention.

Referring to FIG. 7, an alternative embodiment of a drainage layer 104*c* is illustrated. A cross-sectional view of the drainage layer illustrates a wave or sinusoidal configuration of the drainage channels.

While illustrative embodiments have been illustrated and described, it will be appreciated that various changes can be made therein without departing from the spirit and scope of the invention.

The embodiments of the invention in which an exclusive property or privilege is claimed are defined as follows:

1. A method for constructing a roof on a structure, comprising:

applying a base layer over an underlying support structure, wherein the base layer is impermeable to water;

applying a storage layer over the base layer, wherein the storage layer comprises inert non-growing storage media to absorb and temporarily detain precipitation for gradual release through the storage media; the storage layer has the capacity to detain at least 0.3175 centimeters (0.125 inches) of precipitation when fully saturated and has a hydraulic conductivity of 0.00001 to 0.1 centimeters per second, wherein the storage layer comprises two or more zones having a different hydraulic conductivity, wherein the zones are arranged such that water can be conveyed through the storage layer at variable design rates.

2. The method of claim 1, further comprising applying a drainage layer between the base layer and the storage layer to direct water downslope beneath the drainage layer.

3. The method of claim 2, further comprising applying a separation layer between the drainage layer and the storage layer to support the storage layer.

4. The method of claim 1, further comprising applying a surface layer over the storage layer, wherein the surface layer is permeable to water.

5. The method of claim 2, wherein the drainage layer comprises channels to direct water downslope beneath the drainage layer.

6. The method of claim 1, further comprising applying a drainage layer over the base layer, and a separation layer over the drainage layer before applying the storage layer, and applying a surface layer over the storage layer, wherein the drainage layer is bonded to the base layer, the separation layer is bonded to the drainage layer, the storage layer is bonded to the separation layer, and the surface layer is bonded to the storage layer.

* * * * *